United States Patent [19]

Perkins

[11] 3,958,664

[45] May 25, 1976

[54] FAIL SAFE MECHANISM FOR AUTOMATICALLY DE-ENERGIZING A MULTI-POST VEHICLE HOIST

[75] Inventor: William V. Perkins, Monrovia, Calif.

[73] Assignee: Maxon Industries, Inc., Huntington Park, Calif.

[22] Filed: Oct. 25, 1974

[21] Appl. No.: 518,100

[52] U.S. Cl. ..... 187/8.47; 187/8.69; 254/89 R

[51] Int. Cl.[2] ..... B66F 7/14

[58] Field of Search ..... 187/8.41, 8.47, 8.49, 187/8.5, 8.59, 8.69, 13, 14, 24, 25, 28, 29 R, 46; 254/85, 89 R, 7, 92, 98, 103; 198/232

[56] References Cited

UNITED STATES PATENTS

| | | | |
|---|---|---|---|
| 1,585,596 | 5/1926 | Menges | 187/8.47 |
| 1,699,785 | 1/1929 | Geiger | 187/29 R |
| 1,990,241 | 2/1935 | Mizer | 187/29 R |
| 2,184,801 | 12/1939 | McCarthy | 187/8.59 |
| 2,230,745 | 2/1941 | Eiselstein | 198/232 |
| 2,624,546 | 1/1953 | Haumerson | 187/8.59 |
| 2,639,784 | 5/1953 | Strock | 187/8.59 X |
| 2,843,223 | 7/1958 | Villars | 187/8.47 |
| 2,932,382 | 4/1960 | James | 198/232 |
| 3,291,260 | 12/1966 | Woor | 187/8.47 |
| 3,687,234 | 8/1972 | Gendreau | 187/8.59 X |
| 3,799,292 | 3/1974 | Katz | 187/25 |

*Primary Examiner*—Evon C. Blunk
*Assistant Examiner*—James L. Rowland
*Attorney, Agent, or Firm*—Frederick E. Mueller

[57] ABSTRACT

The lifting mechanisms of each of a plurality of columns of a vehicle hoist are synchronously driven by an endless member which may have its power source on one of the columns. A switch to energize and de-energize the power source has a control arm that is coupled, through a lost motion mechanism, to a trigger-like, normally inactive safety mechanism that is held cocked by a safety rod. A rotary idler carried by the safety rod is biased against the endless member in a direction to withdraw the rod from the safety mechanism in the event of a break in the endless member, releasing the trigger energy to effect shifting of the power source switch to the off position by overriding actuation of the lost motion coupling mechanism.

8 Claims, 7 Drawing Figures

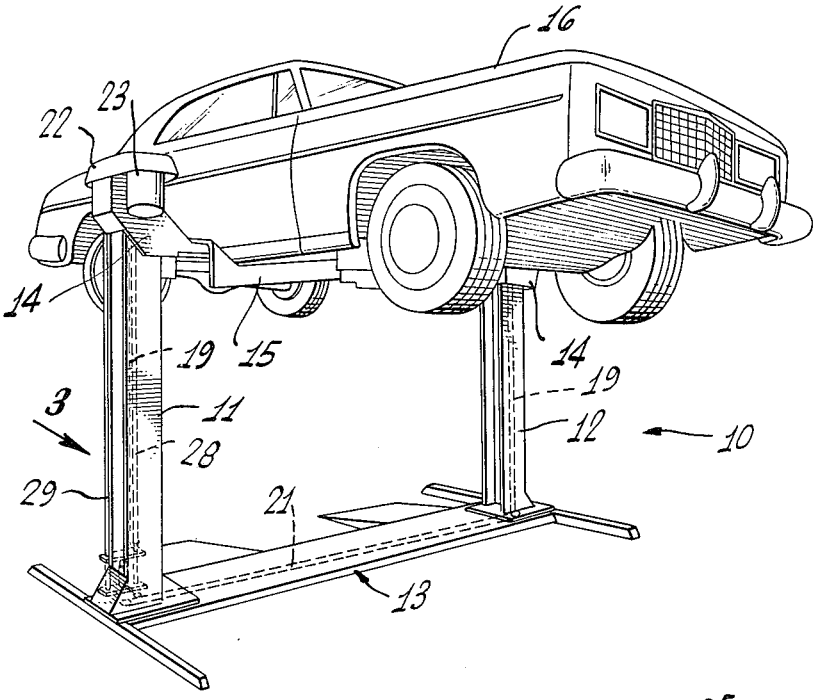
Fig. 1
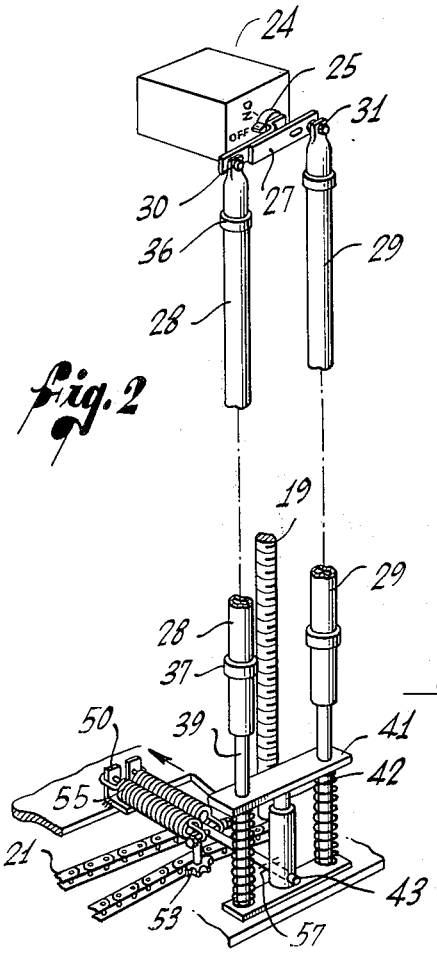
Fig. 2
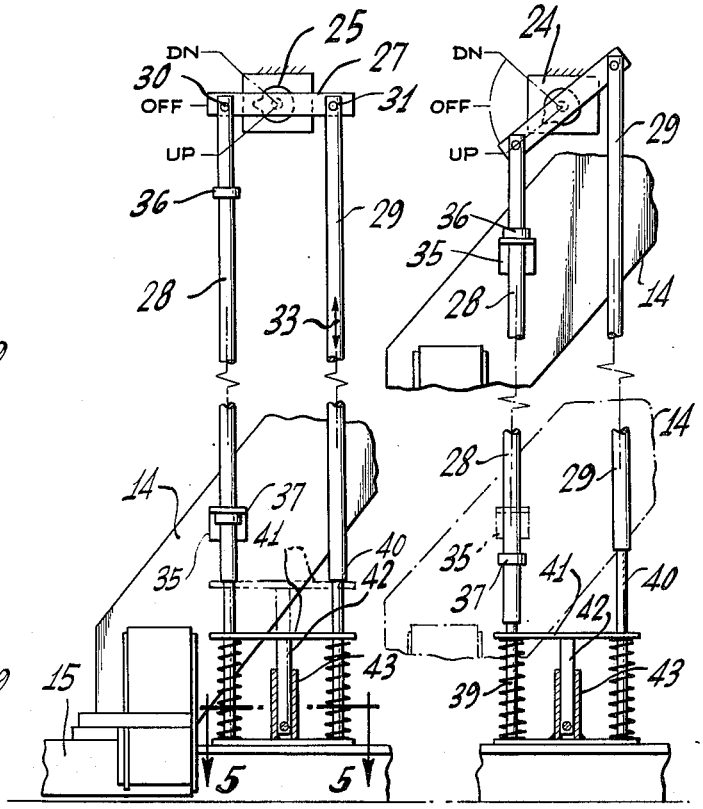
Fig. 3
Fig. 4

FAIL SAFE MECHANISM FOR AUTOMATICALLY DE-ENERGIZING A MULTI-POST VEHICLE HOIST

BACKGROUND OF THE INVENTION

The present invention relates to load lifting and lowering hoists of the type having multiple columns and, more particularly, to safety mechanisms therefor.

Typically, vehicle hoists of the multi-post type include lifting mechanisms, e.g., screw jacks, in each post that are synchronously driven by an endless member, e.g., a sprocket chain. The power source for the endless member may be incorporated into the load bearing carriage of the lifting mechanism of one of the columns, referred to as a drive column. The load bearing elements of all of the columns are thus raised or lowered in unison while engaging opposite sides or ends of the vehicle carried thereon.

A serious problem inherent with such hoists is that breakage of the endless chain stops the vertical movement of only the idler column or columns, the drive column continuing to operate. As a consequence, if the hoist is in the process of raising or lowering a vehicle, the drive column continues to lift or lower the vehicle portion engaged thereby to tilt it to an unstable and unsafe position, in which there is a danger that the vehicle may tumble or fall from the hoist. As is apparent, such malfunction can cause serious damage to the vehicle as well as other property damage and grave personal injury.

At present, some of the currently available multipost hoists do not incorporate any safeguards for stopping the operation of the hoist whenever the endless member breaks. Other currently available hoists of this type do incorporate such safeguards which, however, have generally been unduly complicated and expensive, thus inhibiting widespread usage thereof.

SUMMARY OF THE INVENTION

The present invention eliminates the aforementioned dangers and disadvantages of multi-post hoists of the type driven by a common endless member by providing an improved, reliable, and inexpensive safety mechanism therefore. The safeguard mechanism of the present invention operates to automatically turn off or to prevent actuation of the power source whenever the endless member breaks.

In the presently preferred exemplary embodiment of the invention, the power source is a reversible motor mounted at the upper end of the drive column. The lifting mechanism of each column takes the form of a screw jack mechanism, whose drive screws have their lower ends interconnected in common by an endless chain and sprocket mechanism. Each of the support columns vertically movably mounts a carriage assembly drivingly coupled to the corresponding screw jack mechanism. Accordingly, upon energization of the motor, the carriage assemblies and vehicle supported thereon are raised or lowered in unison.

A reversing drum switch for the motor is provided with an actuating arm that is centrally connected to the hub of the switch actuator, the opposite extremities of the actuator arm having a pair of elongate control tubes vertically suspended therefrom. One of the control tubes extends with clearance through a bracket mounted on the carriage assembly of the drive column and also has a vertically spaced apart pair of stop collars mounted thereon that are unidirectionally engagable with opposite sides of the bracket. In the off position of the actuator arm, the pair of control tubes are suspended in parallel registration, i.g., with their upper and lower ends within the same horizontal planes. Upon relative vertical displacement of the control tubes, as by manually raising or lowering one of them, the switch is closed to energize the motor for rotation in either direction, as desired, in order to raise or lower the carriage assemblies. Upon the bracket of the drive column carriage assembly coming into contact with one of the stop collars, the switch will be returned to the neutral, off position after some overtravel of the carriage and bracket relative to the column.

At the foot or base of the drive column, a pair of vertically extending guide rods are secured in parallel horizontally spaced relation for telescopic engagement with the lower ends of the pair of control tubes. The pair of guide rods also pass freely through a pair of openings formed in opposite ends of a striker bar which is centrally fitted with a downwardly extending guide member that is telescopically receivable within a tubular guide sleeve secured to the base of the drive column. The lower ends of both the striker bar guide and sleeve are formed with alignable transverse apertures normally receiving one end of a safety rod therethrough in order to interlock the two elements together with the striker bar positioned in predetermined spaced relation to the lower ends of the pair of control tubes when the control tubes are positioned in the neutral, off position, thus holding a pair of helical coil springs under compression under the striker bar. The other end of the safety rod is mounted in a guide sleeve secured to the base of the drive column. Between its ends, the safety rod mounts an idler sprocket in driven engagement with one side of the endless chain, the safety rod being spring biased against the chain and in a direction to withdraw the safety rod from the striker bar assembly, the unbroken chain thus normally preventing the safety rod springs from releasing the striker bar mechanism. Upon breaking of the chain, the striker bar is immediately released to be thrust upwardly by the energy of the springs associated therewith to engage the lower end of one or both of the control tubes, in order to, respectively, return the switch to the neutral, off position, or to maintain the switch in the off position.

BRIEF DESCRIPTION OF THE DRAWINGS

FIG. 1 is a perspective view of a vehicle hoist embodying the invention.

FIG. 2 is a partially cut away perspective view of safety mechanism according to the present invention associated with the drive column of the hoist of FIG. 1.

FIG. 3 is a side elevation of the safety mechanism of FIG. 2, taken as indicated in FIG. 1, illustrating the switch arm arrangement associated with the hoist power source shifted to an off position, the switch arm striking mechanism being illustrated held in a first retracted position in solid lines and in dashed lines released to assume a second, extended position.

FIG. 4 is a side elevation, like FIG. 3, illustrating the switch arm striking mechanism held in the first retracted position and the switch arm arrangement shifted to energize the vehicle hoist to raise a vehicle.

DESCRIPTION OF THE PREFERRED EMBODIMENT

The present invention may be employed in a variety of hoists of the type employing a tensioned member, either in the form of an endless member or a member of finite length. These devices may take the form of single or multi-post lifts employing chains, cables, or the like, either in endless form or of finite length, operatively associated with means to translate actuation of a motor or the like into vertical movement of a load bearing carriage assembly supported on the posts. The invention appears to have its greatest utility in hoists of the multi-post type, employing screw jack mechanisms to accomplish the raising and lowering of the load. Accordingly, the presently preferred embodiment of the invention takes the form of a twin-post screw jack lift which will, however, be understood to be illustrative and not limitative of the invention.

Figure 5:
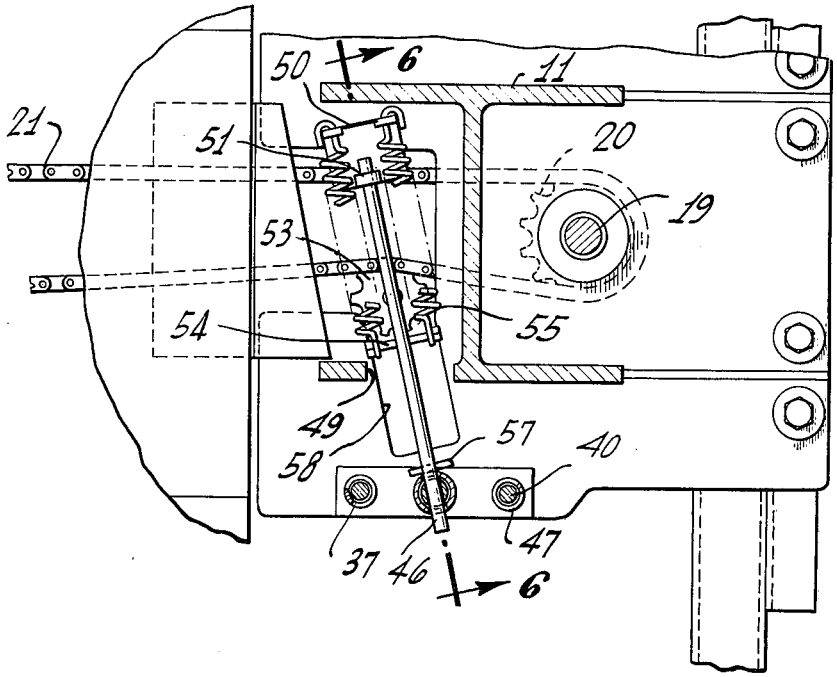
FIG. 5 is a sectional view taken along the line 5—5 of FIG. 3.

Referring to FIG. 1, a twin-post vehicle lift or hoist is designated generally by the numeral 10. The hoist includes a pair of opposite side load columns 11 and 12 having their bases rigidly interconnected to opposite sides of a ground supported framework 13 that is generally H-shaped in plan configuration. As is indicated in FIG. 5, the posts 11 and 12 may take the form of lengths of beams of H-shaped cross-sectional configuration and each is fitted with a carriage assembly 14 that is vertically movably supported by the corresponding column 11 or 12. As is conventional, each of the carriage assemblies 14 is fitted with a pair of horizontally swingable arms 15, each terminating in a support pad, whereby a plurality of pads of the pair of carriage assemblies may be swung into and out of registration with support points on the chassis of the vehicle 16.

Each of the columns 11 and 12 supports a vertically extending screw jack assembly drivingly coupled to the corresponding carriage assembly 14. Such screw jack assemblies and the manner of their mutual interconnection are well known and, accordingly, will not be described in detail. It will be understood that each screw jack includes a load bearing drive nut supporting a carriage assembly 14 in a manner to translate rotation of a drive screw 19 into raising or lowering of the carriage assembly and that each of the drive screws 19 is keyed at its lower end to a sprocket 20, the pair of sprockets being synchronously coupled together by an endless sprocket chain 21.

In order to turn the screws, one of the columns, e.g., the column 11, has a mounting or housing 22 secured to its upper end which, in turn, supports a reversible motor 23 that is drivingly coupled with the corresponding drive screw 19. Thus, when the motor 23 is energized, the carriage assemblies are raised or lowered in unison, depending upon the direction of rotation of the motor 23. As the column 11 incorporates the drive motor, it is typically referred to as the drive column, while the other column or columns synchronously coupled to the drive screw of the drive column are referred to as idler columns.

In order to control the energization and de-energization of the motor 23, as well as its direction of rotation, the housing 22 also supports a drum switch 24 that is electrically connected to the motor 23. As is shown in FIGS. 2 through 4, the switch 24 is of the three position type, having a protruding switch hub 25 with a radially extending indicator to visually signal off, down, and up positions of the switch, the switch preferably being fitted with detent mechanisms for each of the three positions.

The motor and switch at the head of the drive column 11 are controllable by an operator on the ground by means of the linkage mechanism seen in FIGS. 2 through 4. Thus, a switch actuator bar 27 is centrally secured to the switch hub 25 to extend horizontally outwardly to opposite sides of the hub when the switch is in the off position. At each of its extremities, the actuator bar 27 supports a pair of elongate control tubes 28 and 29, which are pivotally suspended in vertically depending position from the actuator bar as indicated at 30 and 31 respectively. The control tubes 28 and 29 are of the same length so that when the switch is in the off position the upper and lower ends of the tube terminate in the same horizontal planes and are disposed in parallel registration.

Preferably, the control tube 29, which is laterally outermost, serves as the member for manually turning the switch to any one of the three indicated positions. For this purpose, it may be marked with an appropriate up-down decal, as indicated at 33, showing the direction in which the control tube is to be vertically displaced in order to effect corresponding raising or lowering of the carriage assemblies 14.

The switch control linkage also incorporates a limit switch arrangement to automatically de-energize the motor 23 upon the carriage assembly of the drive column 11 reaching the desired limits of its vertical range of travel. Thus, the drive column carriage assembly 14 carries an outstanding bracket 35, a horizontal flange of which is formed with an opening through which the control tube 28 freely passes. A pair of stop collars 36 and 37 are adjustably clamped to the control tube 28 on opposite sides of the bracket 35, for engaging opposite sides of the horizontal flange of the bracket. With this arrangement, as will be apparent from an examination of FIGS. 3 and 4, when the carriage assembly 14 is being raised the bracket 35 ultimately engages the underside of the upper stop collar 36 and, after a limited overtravel of the carriage and bracket subsequent to initial engagement of the parts, the switch is returned to the off position. Conversely, when the carriage assembly is descending it ultimately engages the lower stop collar 37 to return the switch to the off position, after the limited overtravel takes place.

Figure 6:
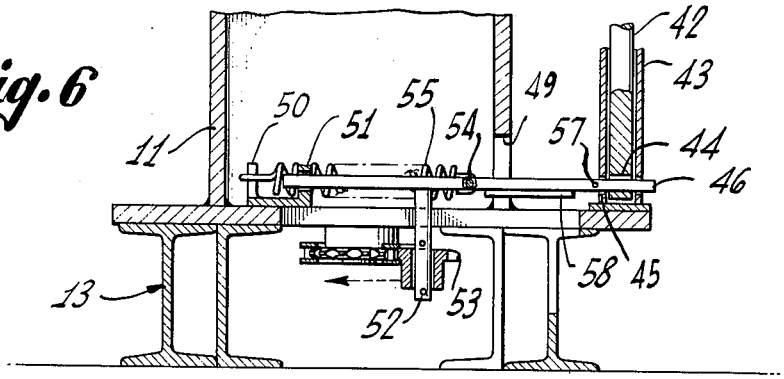
FIG. 6 is a view taken along the line 6—6 of FIG. 5.
Figure 7:
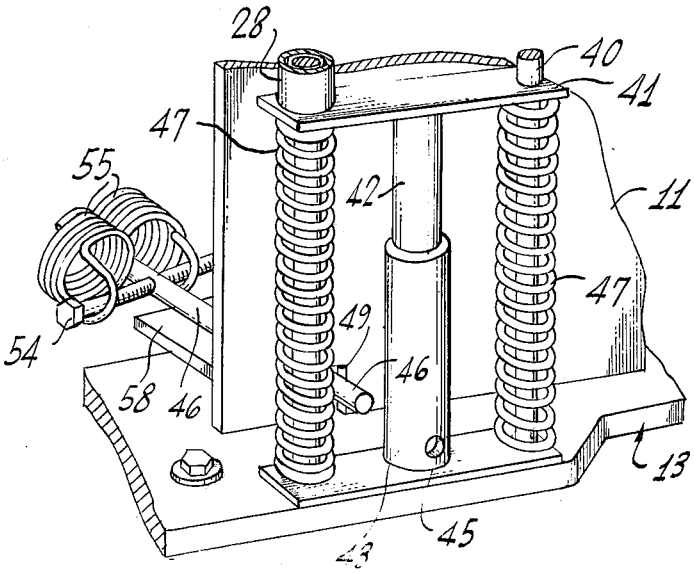
FIG. 7 is a partial, perspective view schematically illustrating the release of the fail-safe mechanism.

At the foot of the drive column 11, the base framework of the hoist rigidly mounts a horizontally spaced-apart pair of vertically extending guide rods 39 and 40, which are telescopically receivable within lower ends of the control tubes 28 and 29, respectively. As is indicated in FIG. 4, these guide rods are of sufficient length to have their upper ends retained within the lower end of the control tubes in positions of maximum vertical displacement of the control tubes. The guide rods 39 and 40 also vertically slidably mount a horizontally disposed striker bar 41, the latter being formed at its opposite ends with bores slidably receiving the guide rods. At its midpoint, the striker bar 41 has a downwardly projecting guide member 42 rigidly secured thereto whose lower end is, in turn, axially slidably receivable through the upper end of a guide sleeve 43 having its lower end rigidly secured to the base framework midway between the guide rods 39 and 40. As is best seen in FIG. 6, the guide member 42 and sleeve 43 are formed at their lower ends with alignable transverse bores 44 and 45, respectively to receive the outer end of a horizontally disposed safety rod 46. Each of the guide rods 39 and 40 has a helical spring 47 mounted thereon, beneath the striker bar 41, which is held under compression against the base framework when the guide member 42 and sleeve 43 are interlocked by the safety rod 46.

In FIG. 3, the switch control linkage is shown in the switch off position, with the lower ends of the control tubes 28 and 29 in vertically spaced relation to the solid outline locked position of the striker bar 41. This spacing is sufficient to allow the desired full range of vertical displacement of the switch control tubes 28 and 29, as indicated in FIG. 4, during normal operation. When the striker bar 41 is released it is moved to the dotted outline position of FIG. 3 by the compression springs 47. Preferably, the striker bar guide 42 is of sufficient length that when the striker bar is released the lower end of the guide member 42 is retained by the guide sleeve 43 whereby the energy of both springs 47 tends to be uniformly exerted against the lower ends of both control tubes 28 and 29, in effect counterbalancing the forces exerted on opposite ends of the switch actuator arm 27 to maintain it in a neutral, off position, or to drive the linkage to this neutral condition, assuming the control tubes 28 and 29 to be in positions of relative vertical displacement.

In order to mount the safety rod 46 in operative alignment with the apertures of the striker guide 42 and sleeve 43, a bracket 50 is secured to the base of the drive column 11 having a guide collar or sleeve 51 receiving the inner end of the safety rod, which passes through an opening 49 in the column 11. Intermediate its ends, the safety rod 46 has a downwardly projecting shaft 52 secured thereto for mounting an idler sprocket 53 in driven engagement with the endless chain 21. On that side, opposite to the bracket 50 from the idler sprocket 53, the rod 46 has a transverse member 54 rigidly secured thereto for holding an end of each of a pair of springs 55 having their opposite ends hooked to an upstanding flange of the bracket 50. The springs 55 are in tension and, accordingly, normally bias the safety rod 46 in a direction to effect its withdrawal from the striker bar of the assembly. However, releasing movement of the safety rod 46 is normally prevented by the endless chain 21. Referring to FIG. 5, the force of the springs 55 is preferably sufficient to deflect that flight of the chain opposing the spring force.

It will be appreciated that as the idler sprocket 53 is driven by the chain 21, the safety rod 46 may shift axially due to variations in the tension of the endless chain 21. In order to prevent escape of the inner end of the safety rod 46 from its guide 51, a roll pin 57 is inserted transversely through a bore in the outer end portion of the safety rod for abutment with the inside of the guide sleeve 43. When the chain 21 is running, the safety rod 46 may also be subjected to torsional forces which are resisted by a plate 58 secured to the underside of the rod 46 outwardly of the cross-member 54 and engagable with the upper face of the base frame.

It will be noted that the fail-safe mechanism in no way interferes with the normal operation of the vehicle hoist since, so long as the chain 21 remains intact, the striker bar 41 is at all times positively retained in the solid outline position of FIG. 3 and FIG. 4. On the other hand, in the event of breaking of the chain 21, whether the switch control linkage be in the condition of FIG. 3 or in a switch on position, as for example the vehicle raising mode illustrated in FIG. 4, the safety rod 46 is immediately withdrawn from the aligned apertures of the guide member 42 and guide sleeve 43. As a result, the energy of the striker bar springs 47 immediately thrusts the striker bar 41 into engagement with either one or both of the lower ends of the control tubes 28 and 29 in order to move or to forcefully maintain the control tubes in the neutralized switch off position illustrated in FIG. 3.

While the presently preferred embodiment of the invention has been described in detail in conjunction with a twin post vehicle lift, it will be understood that the invention is readily susceptible of taking other forms in single or multi-post lifts utilizing a tensioned member of finite or endless length whose breakage can be sensed by a biased element.

What is claimed is:

1. A load lifting and lowering hoist comprising:

a vertically extending framework having a load bearing means vertically moveably mounted thereon;

a power means coupled to said load bearing means for raising and lowering said means, and including a linear element;

a control means to activate said power means for raising or lowering said load bearing means by movement of a control arm having a neutral, off position in which said power means is de-energized, said control arm comprising a rotary element, said control means including a parallel pair of link members pivotally connected at one end to diametrically opposite extremities of said control arm, in parallel;

a striker means having a lost-motion connection to said control arm, said striker means having a normally retracted position beyond the range of movement of said control arm, said striker means comprising a bar mounted in opposition to the other ends of said pair of links;

normally inactive means which, upon release, moves said striker means into an extended position against said other ends of said link members to hold said control arm in said neutral, off position; and means responsive to breakage of said linear element to release said normally inactive means to effect movement of said striker means to said extended position.

2. A load lifting and lowering hoist as in claim 1 in which said linear element comprises a sprocket chain and said means responsive to breakage of said linear element includes an idler sprocket, said sprocket chain and said idler sprocket being mounted in resilient opposition.

3. A load lifting and lowering hoist as in claim 1 in which said vertically extending framework comprises a plurality of upstanding columns, each column having one of said load bearing means, said linear element being endless in form and responsive to actuation of said power means to effect raising or lowering of said load bearing means in unison.

4. A load lifting and lowering hoist comprising:

a plurality of vertically extending columns, each of which vertically moveably mounts a carriage assembly;

a power means mounted in an elevated position on one of said columns;

power transmission means for effecting raising and lowering of said carriage assemblies in response to energization of said power means, said power transmission means including an horizontally endless member extending between bases of said plurality of columns;

a manual control means on said power means for energizing and de-energizing said power means;

a biased remote control means at the base of said one column that is held in a normally retracted inactive position out of the range of movement of said manual control means by a trigger means;

a trigger means connected between said remote control means and said endless member to translate breakage or excessive deflection of said endless member into release of said biased, normally retracted remote control means;

a guide means interconnected between said manual control means and said remote control means with a lost motion connection permitting actuation of said manual control means when said remote control means is in retracted position and translates extension of said remote control means into movement of, or holding of, said manual control means in a position in which said power means is de-energized.

5. The invention as defined in claim 4 in which said guide means comprises a pair of telescopically engaged vertically extending members that are in mutually slidable contact to provide said lost motion connection.

6. The invention as defined in claim 5 in which said manual control means comprises a rotary switch arm and said guide means includes a parallel pair of pairs of said telescopically engaged vertically extending members having upper ends connected to opposite ends of said switch arm.

7. The invention as defined in claim 6 in which said biased remote control means comprises a striker bar having opposite ends supported on said guide means, both ends of said striker bar being spring loaded.

8. The invention as defined in claim 7 in which said parallel pair of pairs of telescopically engaged members comprises a pair of tubular link members having lower ends engagable by opposite ends of said striker bar upon release of said remote control means by said trigger means effecting extension of said spring loaded striker bar.

* * * * *